US008687995B2

(12) United States Patent
Kim et al.

(10) Patent No.: US 8,687,995 B2
(45) **Date of Patent: *Apr. 1, 2014**

(54) FUSING DEVICE OF AN ELECTROPHOTOGRAPHY IMAGE FORMING APPARATUS INCLUDING A HEATING ROLLER

(71) Applicant: Samsung Electronics Co., Ltd., Suwon-si (KR)

(72) Inventors: Jin-han Kim, Suwon-si (KR); Byung-sang Yun, Yongin-si (KR); Kyung-hwan Kim, Seongnam-si (KR); Jun-o Kim, Yongin-si (KR); Young-dae Ko, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/904,262

(22) Filed: May 29, 2013

(65) Prior Publication Data

US 2013/0259549 A1 Oct. 3, 2013

Related U.S. Application Data

(63) Continuation of application No. 12/897,931, filed on Oct. 5, 2010, now Pat. No. 8,467,696.

(30) Foreign Application Priority Data

Oct. 20, 2009 (KR) ..... 10-2009-0099834

(51) Int. Cl.
*G03G 15/00* (2006.01)
*G03G 15/20* (2006.01)

(52) U.S. Cl.
USPC ..... 399/90; 399/333

(58) Field of Classification Search
USPC ..... 399/90, 328–330, 333, 334; 219/216
See application file for complete search history.

(56) References Cited

U.S. PATENT DOCUMENTS

| | | | | |
|---|---|---|---|---|
| 4,801,968 | A * | 1/1989 | Kogure et al. | 399/334 |
| 5,826,152 | A * | 10/1998 | Suzuki et al. | 399/330 |
| 6,091,059 | A * | 7/2000 | Sato et al. | 219/216 |
| 6,272,308 | B1 * | 8/2001 | Maeda et al. | 399/328 |
| 7,026,578 | B2 * | 4/2006 | Mori et al. | 219/216 |
| 7,447,475 | B2 * | 11/2008 | Ishibe et al. | 399/329 |
| 8,055,177 | B2 * | 11/2011 | Lee et al. | 399/333 |
| 8,467,696 | B2 * | 6/2013 | Kim et al. | 399/90 |

FOREIGN PATENT DOCUMENTS

| | | |
|---|---|---|
| JP | 2000097379 | 4/2000 |
| JP | 2006084805 | 3/2006 |

* cited by examiner

*Primary Examiner* — William J Royer
(74) *Attorney, Agent, or Firm* — Stanzione & Kim, LLP

(57) ABSTRACT

A heating roller including a resistive heating layer and a fusing device including the heating roller. By separately disposing a plurality of electrodes in an axis direction of the heating roller, and by independently controlling each electrode, the heating roller may correspond to various papers having different sizes. Accordingly, the temperature of the heating roller may be stably controlled.

20 Claims, 13 Drawing Sheets

FUSING DEVICE OF AN ELECTROPHOTOGRAPHY IMAGE FORMING APPARATUS INCLUDING A HEATING ROLLER

CROSS-REFERENCE TO RELATED APPLICATIONS

This application is a Continuation application of prior application Ser. No. 12/897,931, filed on Oct. 5, 2010 in the United States Patent and Trademark Office, which claims the benefit of Korean Patent Application No. 10-2009-0099834, filed on Oct. 20, 2009, in the Korean Intellectual Property Office, the disclosure of which is incorporated herein in its entirety by reference.

BACKGROUND

1. Field of the Invention

The present general inventive concept relates to a heating roller including a resistive heating layer, and a fusing device including the heating roller.

2. Description of the Related Art

Electrophotography type image forming apparatuses supply a toner to an electrostatic latent image formed on an image receiving body to form a visible toner image on the image receiving body, to transfer the toner image onto a printing medium, such as a piece of paper, and to fuse the transferred toner image onto the printing medium. The toner is fabricated by adding various functional additives to a base resin. The fusing process is performed by heating and compressing the transferred toner. A large amount of energy is used by an electrophotography type image forming apparatus during the fusing process.

Generally, a fusing device includes a heating belt and a compressing roller engaged to each other to form a fixing nip. Alternatively, a general fuse device may include a heating roller and a compressing roller that are engaged to each other to form a fixing nip. While a printing medium having toner transferred thereon passes through a fixing nip, heat and pressure are applied to the toner. In order to generate heat, a heating belt or a heating roller may be heated by radiant heat from a halogen lamp installed in a fuse device. Alternatively, a resistive heating element such as a ceramic heater may be attached around the fixing nip so as to generate heat by using a resistive heating method. A resistive heating element may also be formed on a heating belt or a heating roller to generate heat thereon.

SUMMARY

The present general inventive concept provides a heating roller including a resistive heating layer, and a fusing device including a plurality of electrodes to apply voltage to the resistive heating layer. A fusing temperature may be controlled by controlling electrodes according to paper size. A temperature of a high-speed fusing system may be maintained when high-speed printing is consecutively performed, as compared to a conventional planar heater having low thermal capacity.

Additional features and utilities of the present general inventive concept will be set forth in part in the description which follows and, in part, will be obvious from the description, or may be learned by practice of the present general inventive concept.

The foregoing and/or other features and utilities of the present general inventive concept may be achieved by providing a heating roller including a supporter having a cylindrical outer circumference; a resistive heating layer to provide resistance-heating by electrical conduction, wherein the resistive heating layer is formed on an outer circumference of the supporter; and a plurality of electrodes disposed between the supporter and the resistive heating layer, and electrically connected to the resistive heating layer to supply power to the resistive heating layer, wherein the plurality of electrodes are spaced apart in an axis direction of the supporter.

The plurality of electrodes may include three electrodes or more.

The plurality of electrodes may each have a ring shape to surround portions of the outer circumference of the supporter.

The plurality of electrodes may be arranged in intervals to correspond to papers having different sizes.

A stepped portion or a groove to accommodate at least a part of the plurality of electrodes may be formed on the outer circumference of the supporter.

The heating roller may further include a release layer formed on an outer circumference of the resistive heating layer.

The heating roller may further include an elastic layer disposed between the resistive heating layer and the release layer.

The heating roller may further include a protective layer disposed between the resistive heating layer and the elastic layer to provide insulation therebetween.

The heating roller may further include an insulating layer disposed between the plurality of electrodes and the supporter.

The heating roller may further include a heat insulating layer disposed between the plurality of electrodes and the supporter. The heating roller may further include a plurality of electrode terminals disposed at ends of the supporter, and being connected to the plurality of electrodes.

The foregoing and/or other features and utilities of the present general inventive concept may be achieved by providing a fusing device including a heating roller to generate heat; and a compressing element engaged to the heating roller to form a fixing nip, wherein a toner is fused on a medium by heating and compressing the toner on the medium as the medium passes through the fixing nip.

The compressing element may have a roller shape or a belt shape.

The compressing element may include a resistive heating layer disposed on regions corresponding to regions of the heating roller not covered by the resistive heating layer.

The foregoing and/or other features and utilities of the present general inventive concept may be achieved by providing a fusing device including a heating roller to generate heat; a belt surrounding an outer circumference of the heating roller and circulating around the outer circumference; a tension roller applying tension to the belt; and a compressing element engaged to the tension roller to form a fixing nip, wherein the belt is disposed between the tension roller and the compressing element, wherein a toner is fused on a medium by heating and compressing the toner on the medium as the medium passes through the fixing nip.

BRIEF DESCRIPTION OF THE DRAWINGS

The above and/or other features of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
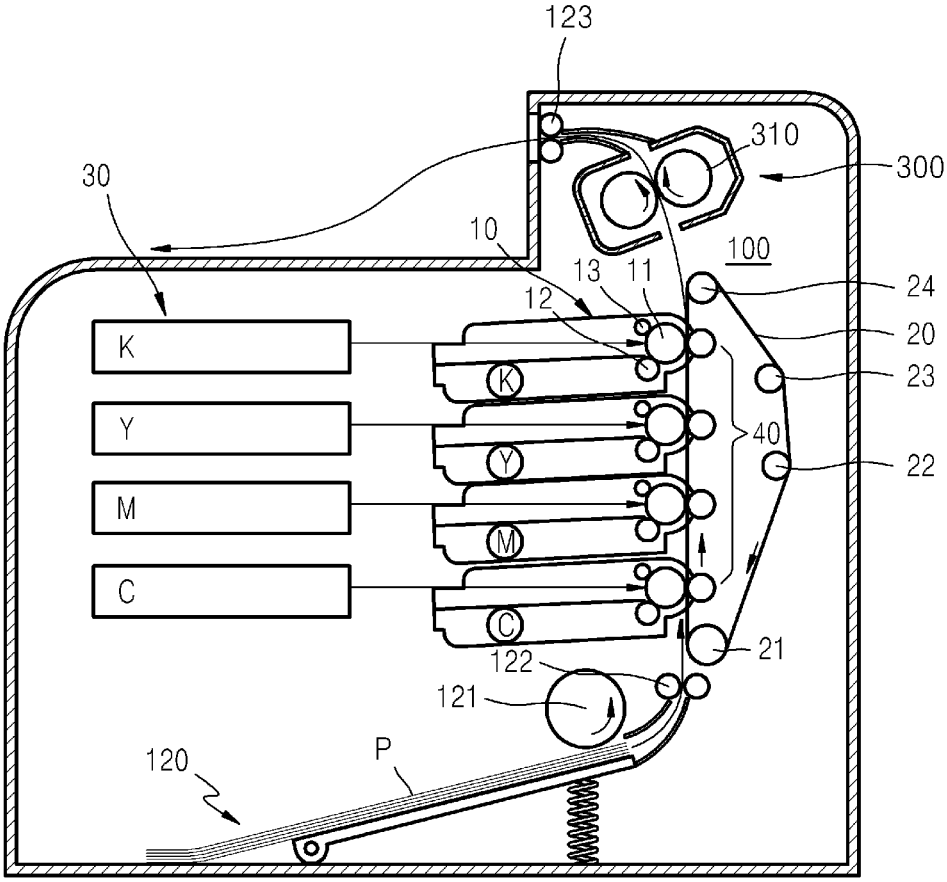
FIG. 1 is a structural view of an electrophotography type image forming apparatus adopting a heating member and a fusing device according to an embodiment of the present general inventive concept.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

FIG. 1 is a structural view of an electrophotography type image forming apparatus 100 adopting a heating member and a fusing device 300 according to an embodiment of the present general inventive concept. Referring to FIG. 1, the image forming apparatus 100 includes a printing unit to print images onto printing media during electrophotography processes, and the fusing device 300. The image forming apparatus illustrated in FIG. 1 may be a dry electrophotography type image forming apparatus 100 to print color images by using a dry developer (hereinafter, the dry developer is referred to as toner).

The printing unit includes a developing unit 10, an exposure unit 30 and a transfer unit. The developing unit 10 includes four developers 10C, 10M, 10Y, and 10K, wherein each developer receives a different color toner, for example, cyan (C), magenta (M), yellow (Y), or black (K). The exposure unit 30 may include four exposing units 30C, 30M, 30Y, and 30K corresponding to the developers 10C, 10M, 10Y, and 10K, respectively.

Each of the developers 10C, 10M, 10Y, and 10K includes a photosensitive drum 11 that is an image receiving body on which an electrostatic latent image may be formed, and a developing roller 12 to develop the electrostatic latent image. A charging roller 13 that supplies an electrical charge is disposed on an outer circumference of the photosensitive drum 11. A charging bias is applied to the charging roller 13 to charge the outer circumference of the photosensitive drum 11 to a uniform electric potential. Alternatively, a corona charger (not shown) may be used in place of the charging roller 13. Toner may be supplied to the photosensitive drum 11 by applying a developing bias to the developing roller 12 to attach toner onto an outer circumference thereof and then transferring the toner to the photosensitive drum 11. Additionally, each of the developers 10C, 10M, 10Y, and 10K may further include a supplying roller to attach toner onto the developing roller 12, a regulating unit to regulate the amount of toner attached onto the developing roller 12, and an agitator to convey toner received in one of the corresponding developers 10C, 10M, 10Y, or 10K toward the supplying roller and/or the developing roller 12. In addition, each of the developers 10C, 10M, 10Y, and 10K may further include a cleaning blade to remove toner remaining on the outer circumference of the photosensitive drum 11 before charging the photosensitive drum 11, and a receiving space to receive the removed toner.

As an example, a transfer unit may include a paper conveying belt 20 and four transfer rollers 40. The paper conveying belt 20 faces the outer circumferences of the photosensitive drums 11, where portions are exposed outside the developers 10C, 10M, 10Y, and 10K. The paper conveying belt 20 is supported by supporting rollers 21, 22, 23, and 24. The supporting rollers 21, 22, 23 and 24 may circulate the paper conveying belt 20. The four transfer rollers 40 are located facing the photosensitive drums 11 of the developers 10C, 10M, 10Y, and 10K with the paper conveying belt 20 interposed therebetween. A transfer bias may be applied to the transfer rollers 40. The exposure units 30C, 30M, 30Y, and 30K may scan light corresponding to image information of cyan, magenta, yellow and black color, respectively, onto the photosensitive drum 11 of each of the developers 10C, 10M, 10Y, or 10K, respectively. In at least one exemplary embodiment, a laser scanning unit (LSU) that uses a laser diode as a light source may be adopted as the exposure units 30C, 30M, 30Y, and 30K.

A process of forming a color image according to the teachings above is described in greater detail below.

The photosensitive drum 11 in each of the developers 10C, 10M, 10Y, and 10K may be charged to achieve a uniform electric potential in response to receiving a charging bias applied by the charging roller 13. The four exposure units 30C, 30M, 30Y, and 30K scan light corresponding to the image information of cyan, magenta, yellow, and black colors, respectively, onto the photosensitive drums 11 of the developers 10C, 10M, 10Y, and 10K, respectively, to form electrostatic latent images. The developing bias is applied to the developing rollers 12 to attach toner onto the outer circumferences of the developing rollers 12 and then the toner is transferred onto the electrostatic latent images so that toner images of cyan, magenta, yellow, and black colors are formed on the photosensitive drums 11 of the developers 10C, 10M, 10Y, and 10K.

A medium capable of receiving the toner, for example, a paper P, is drawn from a cassette 120 by a pickup roller 121. The paper P is induced onto the paper conveying belt 20 by conveying rollers 122. The paper P is adhered on the paper conveying belt 20 due to an electrostatic force and is conveyed at the same velocity as a traveling velocity of the paper conveying belt 20.

For example, a transfer nip to receive the paper P and toner is provided where the photosensitive drum 11 faces the transfer roller 40 corresponding thereto. A front edge of the paper P reaches the transfer nip at approximately the same time as a front edge of the toner image of cyan (C) color, which is formed on the outer circumference of the photosensitive drum 11 in the developer 10C, reaches the same transfer nip. When the transfer bias is applied to the transfer roller 40 corresponding to the photosensitive drum 11 of the toner image of cyan (C) color, the toner image formed on the photosensitive drum 11 is transferred onto the paper P. As the paper P is conveyed, the toner images of magenta M, yellow Y, and black K colors formed on the photosensitive drums 11 of the developers 10M, 10Y, and 10K are sequentially transferred onto the paper P and overlap each other, and accordingly, a color toner image may be formed on the paper P.

The color toner image formed on the paper P is maintained on the surface of the paper P due to static electricity. The fusing device 300 fuses the color toner image to the paper P by using heat and pressure. The paper P on which the color toner image is fused is discharged out of the image forming apparatus 100 by a discharging roller 123.

Figure 2:
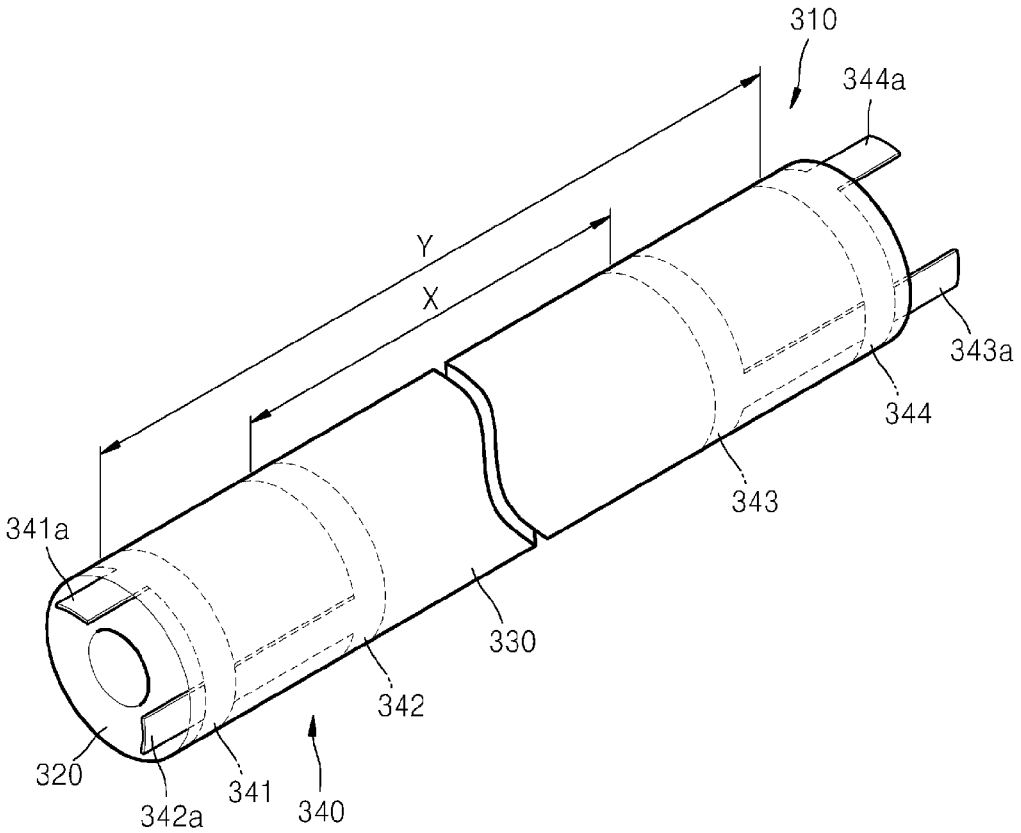
FIG. 2 is a perspective view illustrating an electrode arrangement of a heating roller adopted in the electrophotography type image forming apparatus of FIG. 1, according to an embodiment of the present general inventive concept.

FIG. 2 is a perspective view illustrating an electrode arrangement of a heating roller 310 adopted in the electrophotography type image forming apparatus 100 of FIG. 1, according to an embodiment of the present general inventive concept.

Referring to FIG. 2, the heating roller 310 includes a supporter 320, a resistive heating layer 330 formed on an outer circumference of the supporter 320, and an electrode unit 340 to supply electricity to the resistive heating layer 330. The heating roller 310 may further include an insulating layer, an elastic layer, a release layer, and the like. Configurations of these layers are described in greater detail below.

The supporter 320 has a cylindrical structure to form the shape of the heating roller 310 and to function as a rotational axis of the heating roller 310.

The resistive heating layer 330 may be disposed along an outer circumference of the supporter 320, and the width thereof may be equal to or greater than the maximum width of paper P to be printed. The resistive heating layer 330 may be electrically conducted to generate heat. That is, the resistive heating layer 330 may generate Joule heat when electrical current is supplied to the resistive heating layer 330.

The electrode unit 340 may be disposed between the supporter 320 and the resistive heating layer 330, and may include first, second, third and fourth electrodes 341, 342, 343 and 344 that are spaced apart in an axis direction of the supporter 320, and first, second, third and fourth electrode terminals 341*a*, 342*a*, 343*a* and 344*a* to electrically connect the first, second, third and fourth electrodes 341, 342, 343 and 344 to the outside, respectively. The first, second, third and fourth electrodes 341, 342, 343 and 344 may each have a ring shape to surround the supporter 320 along portions of the outer circumference of the supporter 320 so that a uniform electrical current may flow through the supporter 320.

The first, second, third and fourth electrodes 341, 342, 343 and 344 may be arranged so as to correspond to the widths of different size paper P. According to at least one exemplary embodiment, assuming paper P is to pass over a center of the heating roller 310 (a center feeding method), the first, second, third and fourth electrodes 341, 342, 343, and 344 may be arranged accordingly. That is, viewing the axis of the heating roller 310, the first, second, third and fourth electrodes 341, 342, 343 and 344 may be arranged to be symmetric with respect to a center portion of the heating roller 310. For example, an interval X between the second and third electrodes 342 and 343, which are inside electrodes, may have a length of 210 mm, which corresponds to the width of a paper P of A4 size, and an interval Y between the first and fourth electrodes 341 and 344, which are outside electrodes, may have a length of 297 mm, which corresponds to the width of a paper P of A3 size.

Figure 3:
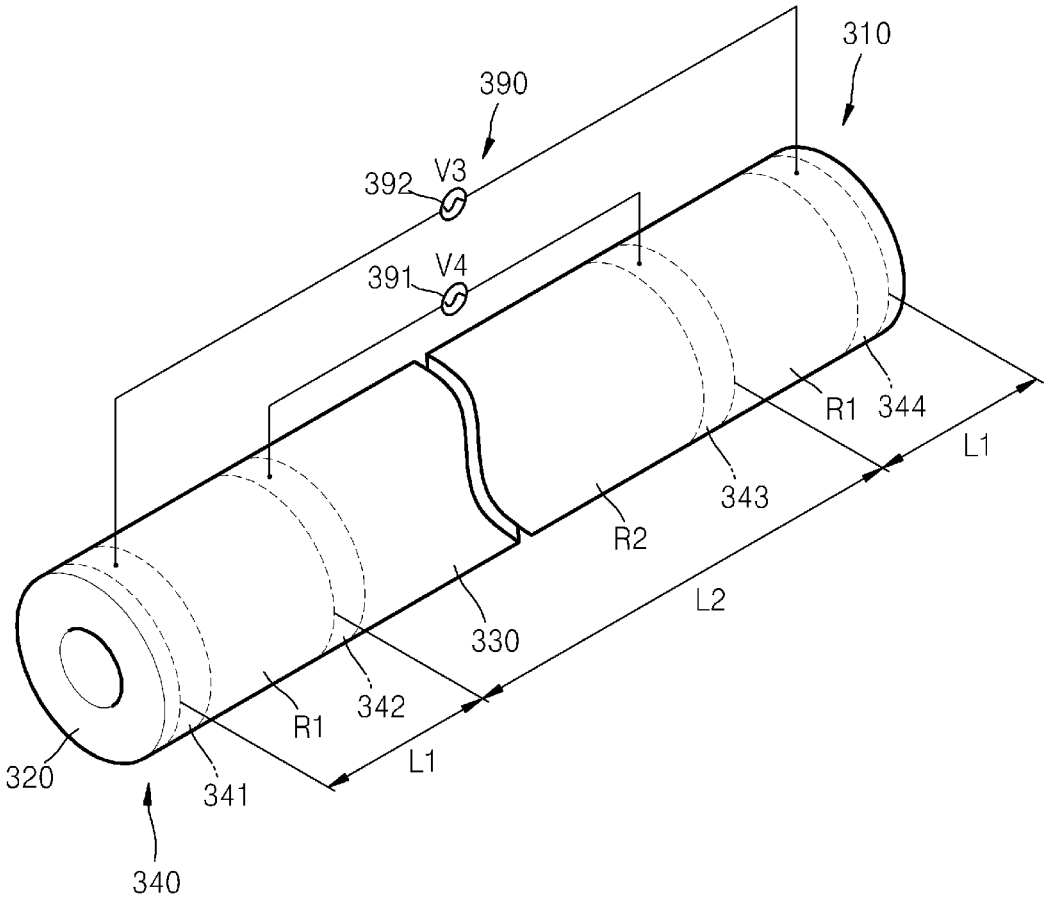
FIG. 3 is a perspective view of a power supplying structure in the heating roller of FIG. 2, according to an embodiment of the present general inventive concept.

FIG. 3 is a perspective view of a power supplying structure 390 in the heating roller 310 of FIG. 2, according to an embodiment of the present general inventive concept.

Referring to FIG. 3, a first power supply 391 supplying a voltage V4 and a second power supply 392 supplying a voltage V3 are connected to the second and third electrodes 342 and 343, which are inside electrodes, and the first and fourth electrodes 341 and 344, which are outside electrodes, respectively. The heating roller 310 may be configured so as to correspond to the widths of different size paper P. That is, in cases of a small-sized paper (e.g., a paper of A4 size), the voltage V3 supplies power between the second and third electrodes 342 and 343 to heat only a central portion of the resistive heating layer 330. Additionally, in cases of a large-sized paper P (e.g., a paper of A3 size), the voltage V4 supplies power between the first and fourth electrodes 341 and 344 to heat the entire resistive heating layer 330. If necessary, the power supplying structure 390 may be configured to supply power between the first and second electrodes 341 and 342, or between the third and fourth electrodes 343 and 344.

In a conventional fusing device, when the width of a heating element that generates heat (i.e., the width of a resistive heating layer of a heating roller) does not correspond to the width of a printing medium, then fusing performance may be degraded, the printing medium may be damaged, or a fusing device having the heating roller may be damaged. A conventional heating element may be set to have a width similar to the maximum width of a printing medium, which passes by the heating element. However, in a fusing device that includes the conventional heating element, the temperature of the ends may be less than the temperature of a center portion during warming-up or while operating in an energy saving mode. As a result, a fusing error may arise at the ends of a printing medium having the maximum width. If an amount of heat supplied to both ends of the heating element is set to be large compared to the central portion of the heating element, temperature drops that occur at the ends may be reduced, and fusing errors are unlikely to occur in a printing medium having the maximum width. However, when printing media having a narrow width are to be consecutively processed, the temperature of a portion of the heating region on which the printing media does not pass may increase greatly, and a fusing error may occur at the ends of the printing medium due to a hot offset. According to at least one exemplary embodiment, the heating roller 310 may prevent degradation of fusing performance, damage to a printing medium, and damage to the fusing device 300, by independently controlling the resistive heating layer 330 in an axis direction of the resistive heating layer 330.

According to at least one exemplary embodiment, heat is generated according to the width of a printing medium by using the first, second, third and fourth electrodes 341, 342, 343 and 344. In this case, if locations of the second and third electrodes 342 and 343, and the first and fourth electrodes 341 and 344 are changed, heating regions of the resistive heating layer 330 are changed, and resistance between the first, second, third and fourth electrodes 341, 342, 343 and 344 are changed. With regard to different sized printing media, in order to drive the fusing device 300 by using the same amount of power, when an area of a heating region of resistive heating layer 330 is changed, voltages of the voltages V3 and V4 may be changed, wherein the voltages of the voltages V3 and V4 are supplied to the second and third electrodes 342 and 343, and the first and fourth electrodes 341 and 344, respectively. For example, when resistance of an end of the resistive heating layer 330 is R1, and resistance of a central portion of the resistive heating layer 330 is R2, total resistance of the resistive heating layer 330 is given by Equation 1.

$$R=2R1+R2 \tag{1}$$

When a voltage V3 corresponding to a large-sized paper (e.g., a paper of A3 size) is applied, and a voltage V4 corresponding to a small-sized paper (a paper of A4 size) is applied, a power P3 corresponding to the paper of A3 size and a power P4 corresponding to the paper of A4 size that are consumed are given by Equation 2.

$$P3=\frac{V3^2}{R},\ P4=\frac{V4^2}{R2} \tag{2}$$

The powers P3 and P4 consumed in the resistive heating layer 330 are the same, and thus the voltage V4 applied to the paper of A4 size is given by Equation 3.

$$V4=\sqrt{\frac{R2}{R}}\,V3=\sqrt{\frac{R2}{2R1+R2}}\,V3 \tag{3}$$

When it is assumed that resistance of the resistive heating layer 330 is uniformly distributed, the voltage V4 applied to the paper of A4 size may be given by Equation 4 using the length of the resistive heating layer 330. In Equation 4, L1 is a length between the first and second electrodes 341 and 342, and a length between the third and fourth electrodes 343 and 344, and L2 is a length between the second and third electrodes 342 and 343.

$$V4=\sqrt{\frac{R2}{R}}\,V3=\sqrt{\frac{R2}{2R1+R2}}\,V3=\sqrt{\frac{L2}{2L1+L2}}\,V3 \tag{4}$$

If the voltages V3 and V4 are to be used to be identical, a region of the resistive heating layer 330 having a resistance of 2R1 is disposed at a side of a compressing roller 370 (see FIG. 10) instead of at a side of the heating roller 310. In addition, in a case of the paper of A3 size, voltage V3 is applied both to the heating roller 310 and a resistive heating layer of the compressing roller 370. In cases of papers of A3 size, voltage V3 is applied only to the second and third electrodes 342 and 343 of the heating roller 310, corresponding to the paper of A4 size.

Figure 4:
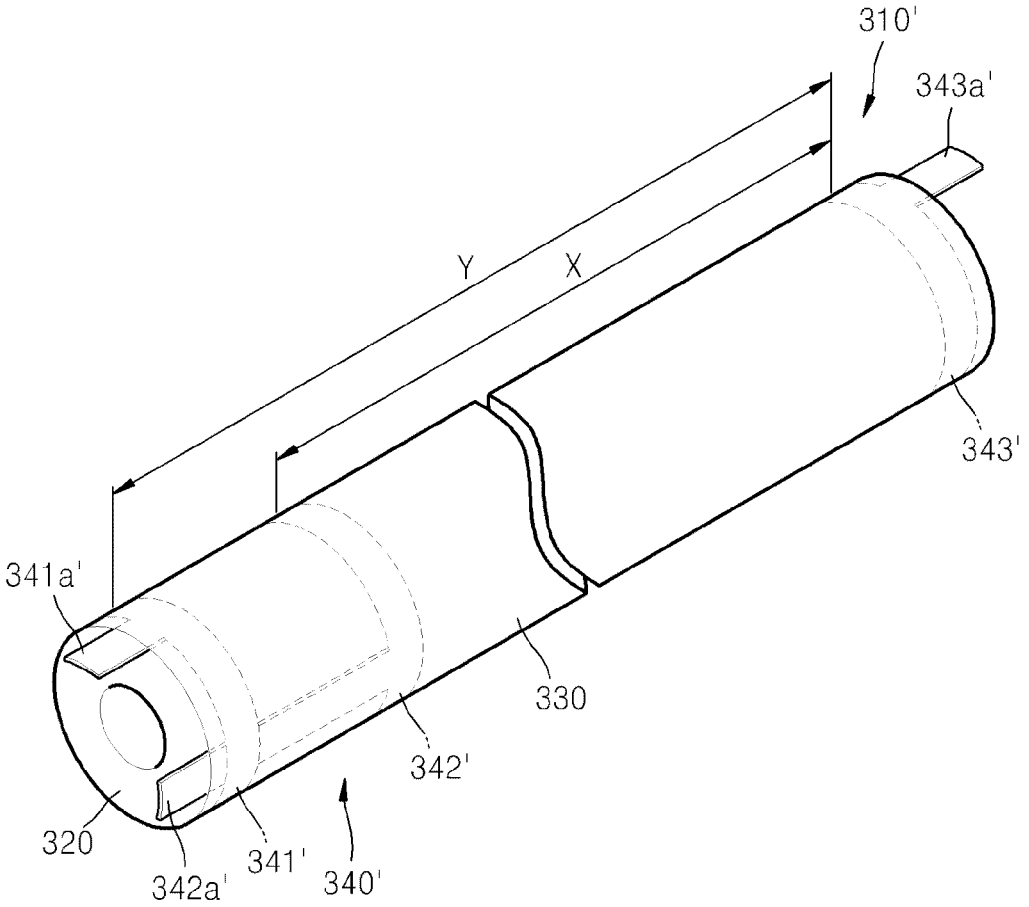
FIG. 4 is a perspective view illustrating an electrode arrangement of a heating roller, according to an embodiment of the present general inventive concept.
Figure 5:
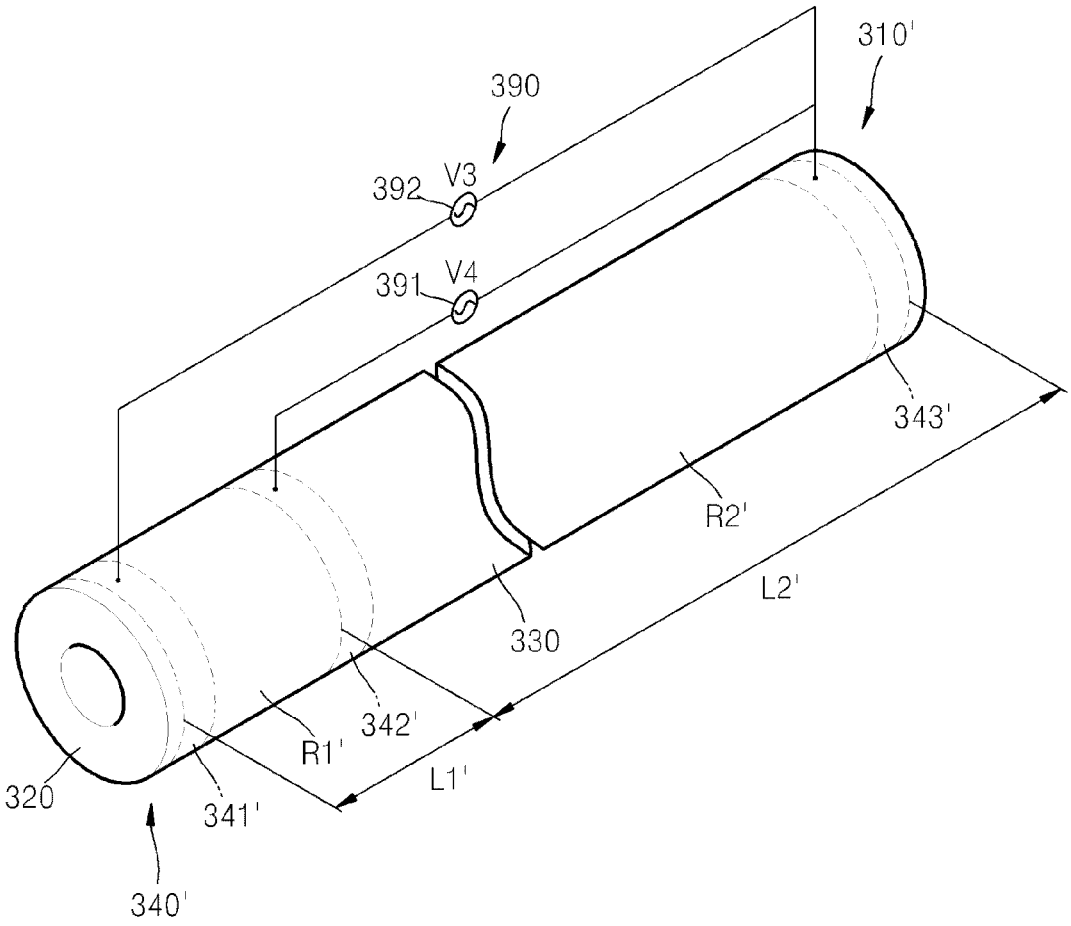
FIG. 5 is a perspective view of a power supplying structure in the heating roller of FIG. 4, according to an embodiment of the present general inventive concept.

FIG. 4 is a perspective view illustrating an electrode arrangement of a heating roller 310', according to an embodiment of the present general inventive concept. FIG. 5 is a perspective view of a power supplying structure 390 in the heating roller 310' of FIG. 4, according to an embodiment of the present general inventive concept.

Referring to FIGS. 4 and 5, the heating roller 310' includes a supporter 320, a resistive heating layer 330 formed on an outer circumference of the supporter 320, and an electrode unit 340' to supply electricity to the resistive heating layer 330. The heating roller 310' according to the present general inventive concept is the same as the heating roller 310, except for the arrangement of the electrode unit 340', and thus the heating roller 310' will be described in terms of the arrangement of the electrode unit 340'. According to an exemplary embodiment, the electrode unit 340' may be arranged to correspond to a fusing device structure in which a paper passes on an end of the heating roller 310' (i.e., a side feeding method). The electrode unit 340' may include first, second and third electrodes 341', 342' and 343' that are spaced apart in an axis direction of the supporter 320, and first, second and third electrode terminals 341*a*', 342*a*' and 343*a*' to electrically connect the first, second and third electrodes 341', 342' and 343' to the outside, respectively. The first and second electrodes 341' and 342' are arranged to correspond to different size paper, and the third electrode 343' is disposed at one end of the heating roller 310' so as to function as a common electrode. For example, the first electrode 341' disposed at the other end of the heating roller 310' is disposed in such a way that a distance Y between the first electrode 341' and the third electrode 343' corresponds to the width of a large-sized paper (e.g., a paper of A3 size), and the second electrode 342', that is, an inside electrode of the heating roller 310', is disposed in such a way that a distance X between the second electrode 342' and the third electrode 343' corresponds to the width of a small-sized paper (e.g., a paper of A4 size). Referring to FIG. 5, L1 is a length between the first and second electrodes 341' and 342', L2' is a length between the second and third electrodes 342' and 343', R1' is a resistance of an end of the resistive heating layer 330, and R2' is a resistance of a central portion of the resistive heating layer 330

When the width of a paper is less than X (i.e., the width of a paper of A4 size), power is supplied to the second and third electrodes 342' and 343' to heat only a central portion of the resistive heating layer 330. When the width of a paper is in the range of X and Y (e.g., a paper of A3 size), power is supplied to the first and third electrodes 341' and 343' so as to heat all of the resistive heating layer 330. Thus, the arrangement of the first, second and third electrodes 341', 342' and 343' may correspond to various papers having different widths.

In the above-described embodiments of the present general inventive concept, an electrode structure corresponding to papers of A3 and A4 sizes has been described. Alternatively, an electrode structure may be used so as to correspond to various papers having different sizes, as shown in Tables 1 to 3. In addition, although two kinds of different-sized papers have been described in the above-described embodiments, it will be understood by one of ordinary skill in the art that a plurality of electrodes to which powers are independently supplied are arranged to correspond to at least three different-sized papers.

TABLE 1

| A- Size | Size | B-size | Size |
|---|---|---|---|
| A0 | 841 mm × 1,189 mm | B0 | 1,030 mm × 1,456 mm |
| A1 | 594 mm × 841 mm | B1 | 728 mm × 1,030 mm |
| A2 | 420 mm × 594 mm | B2 | 515 mm × 728 mm |
| A3 | 297 mm × 420 mm | B3 | 364 mm × 515 mm |

TABLE 1-continued

| A- Size | Size | B-size | Size |
|---|---|---|---|
| A4 | 210 mm × 297 mm | B4 | 257 mm × 364 mm |
| A5 | 148 mm × 210 mm | B5 | 182 mm × 257 mm |
| A6 | 105 mm × 148 mm | B6 | 128 mm × 182 mm |
| A7 | 74 mm × 105 mm | B7 | 91 mm × 128 mm |
| A8 | 52 mm × 74 mm | B8 | 64 mm × 91 mm |
| A9 | 37 mm × 52 mm | B9 | 45 mm × 64 mm |
| A10 | 26 mm × 37 mm | B10 | 32 mm × 45 mm |

TABLE 2

| Division (Envelope) | Size |
|---|---|
| Letter | 215.9 mm × 297.4 mm (Size of letter in Europe and America) |
| Legal | 215.9 mm × 355.6 mm (Size of official document in American Government) |
| Tabloid | 279.4 mm × 431.8 mm (Size of newspaper in Europe and America) |

TABLE 3

| Division (Consecutive paper) | Size |
|---|---|
| 10" (10 inches) | 254.0 mm × 297.4 mm |
| 15" (15 inches) | 381.0 mm × 279.4 mm |

Figure 6:
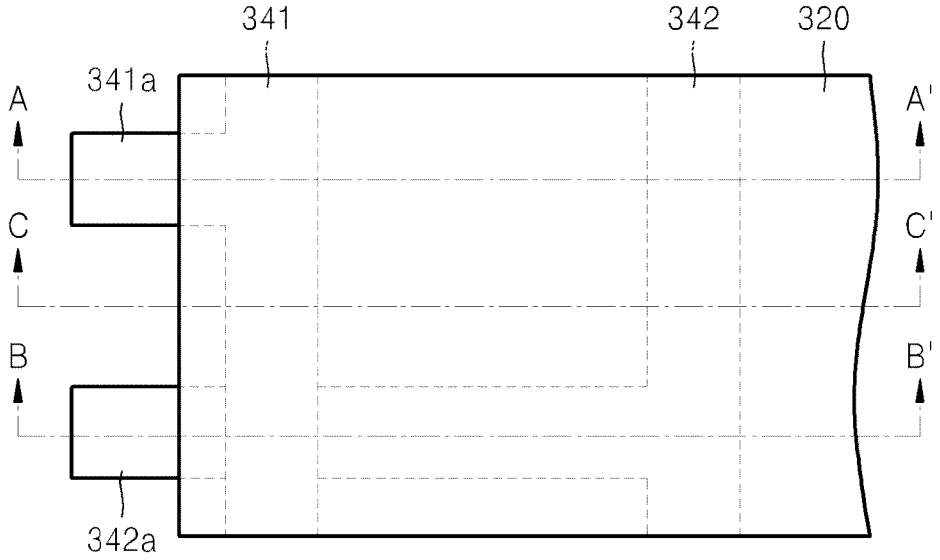
FIG. 6 is a development diagram of a resistive heating layer including first and second electrodes of the heating roller of FIG. 2, according to an embodiment of the present general inventive concept.
Figure 7A:
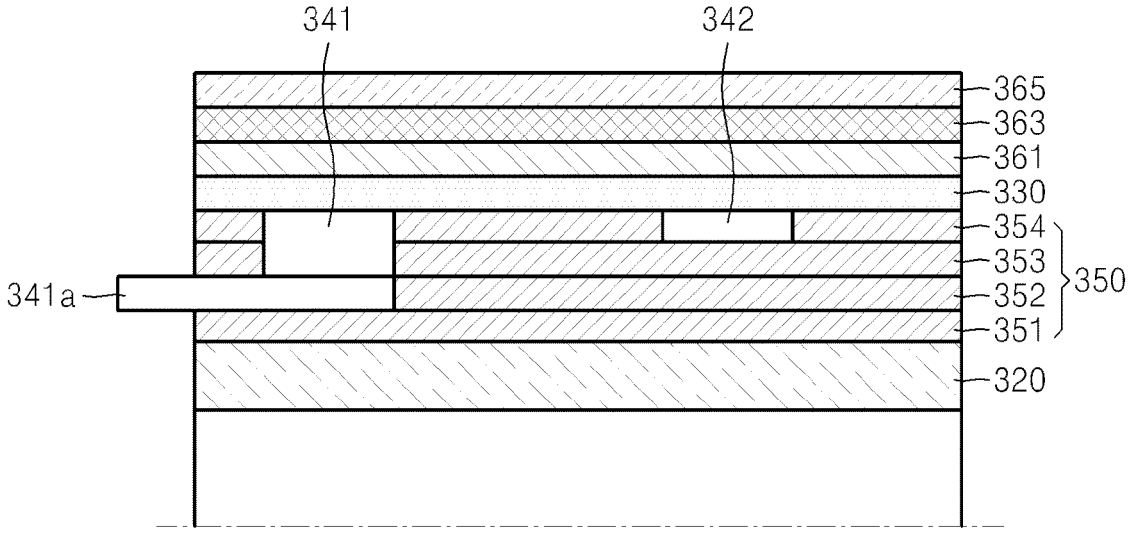
FIGS. 7A through 7C are transverse cross-sectional views of the heating roller of FIG. 6 taken along lines A-A', B-B' and C-C' of FIG. 6, respectively, according to an embodiment of the present general inventive concept.
Figure 7B:
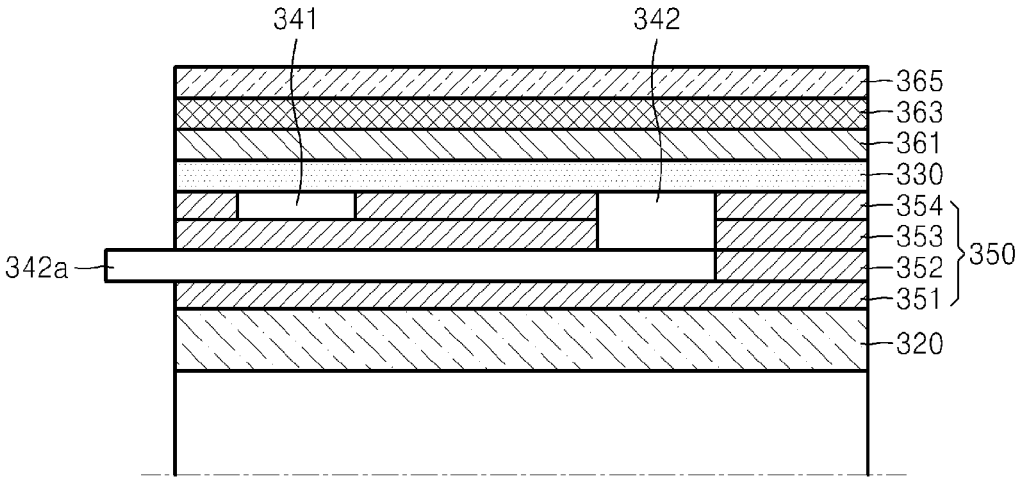
Figure 7C:
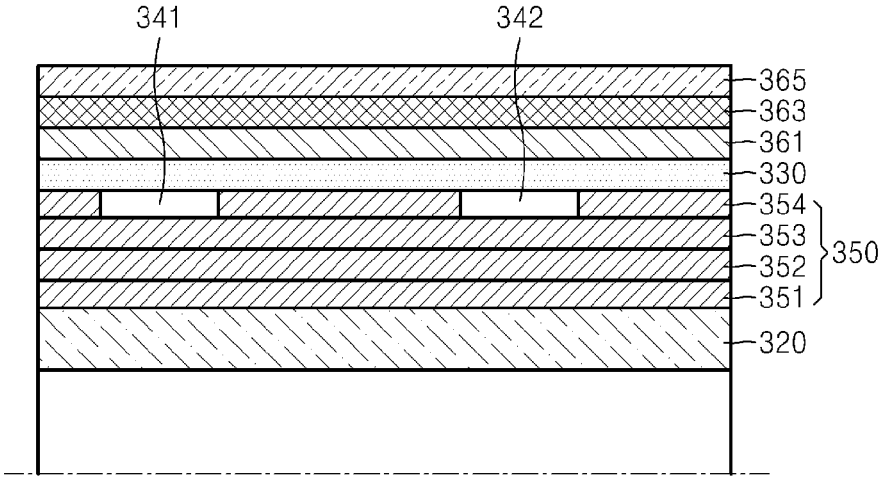

FIG. 6 is a development diagram of the resistive heating layer 310, and the first and second electrodes 341 and 342 in the heating roller 310 of FIG. 2, according to an embodiment of the present general inventive concept. For convenience of description, only the first and second electrodes 341 and 342 are illustrated. FIGS. 7A through 7C are transverse cross-sectional views of the heating roller 310, taken along lines A-A', B-B' and C-C' of FIG. 6, respectively, according to an embodiment of the present general inventive concept.

Referring to FIGS. 7A through 7C, a multi-layered insulating layer 350, the resistive heating layer 330, a protective layer 361, an elastic layer 363 and a release layer 365 are sequentially formed on an outer circumference of the supporter 320. The multi-layered insulating layer 350 may include, for example, first, second, third and fourth layers 351, 352, 353 and 354. First, the first layer 351 is formed to cover the entire outer circumference of the supporter 320. The first electrode terminal 341*a* and the second electrode terminal 342*a* and a wiring structure to connect the first electrode terminal 341*a* and the second electrode terminal 342*a* to the first electrode 341 and the second electrode 342 are formed on the first layer 351 of the insulating layer 350. The second layer 352 and the third layer 353 of the insulating layer 350 are formed on the first layer 351, except for a region occupied by wiring of the first electrode 341 and the second electrode 342. The first electrode 341 and the second electrode 342 are formed in a ring shape. The fourth layer 354 of the insulating layer 350 is formed on the third layer 353, except for a region occupied by the first electrode 341 and the second electrode 342 each having a ring shape. The resistive heating layer 330, the protective layer 361, the elastic layer 363 and the release layer 365 are sequentially formed. A planarization process to planarize an outer circumference of each layer may be performed during each operation, and third and fourth electrodes not illustrated in FIGS. 6 and 7A to 7C may be formed using the same method as the first and second electrodes 341 and 342.

Figure 8A:
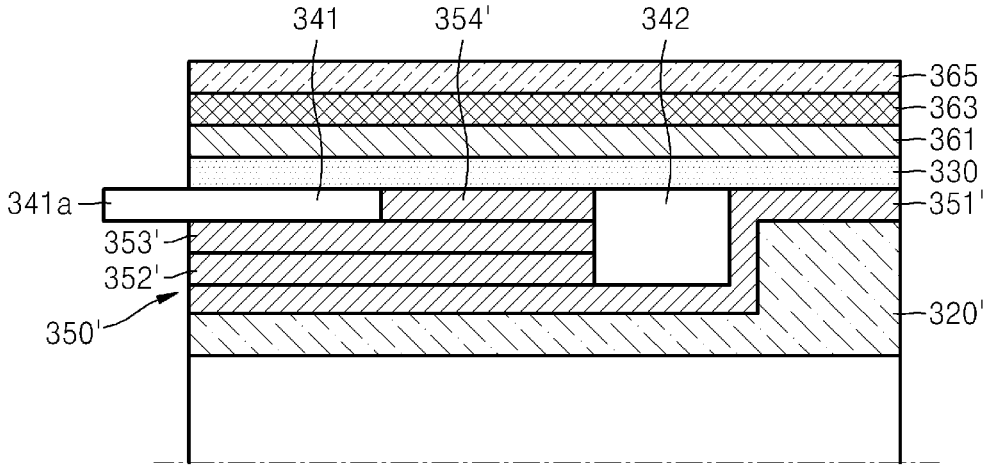
FIGS. 8A through 8C are transverse cross-sectional views of the heating roller of FIG. 6 taken along lines A-A', B-B' and C-C' of FIG. 6, respectively, according to an embodiment of the present general inventive concept.
Figure 8B:
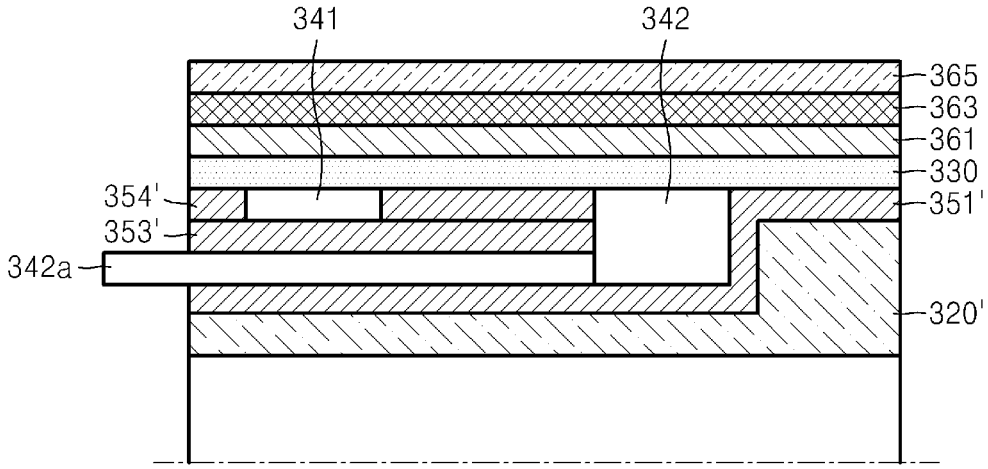
Figure 8C:
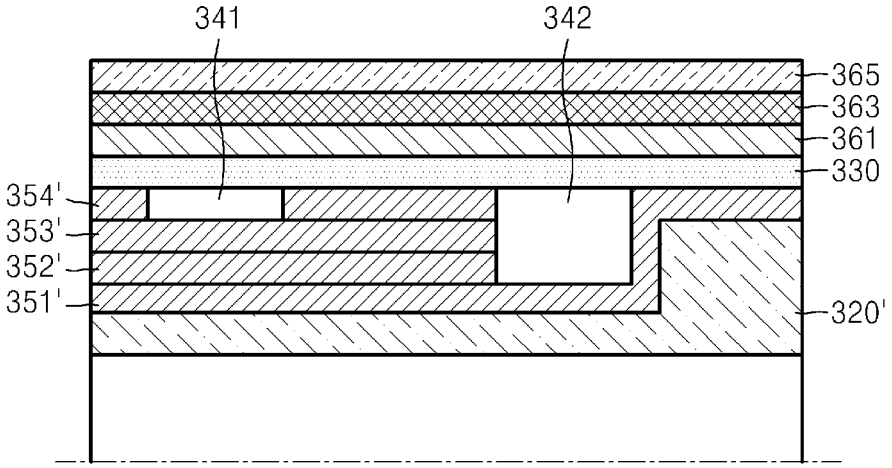

FIGS. 8A to 8C are transverse cross-sectional views of the heating roller 310, taken along lines A-A', B-B' and C-C' of FIG. 6, respectively, according to an embodiment of the present general inventive concept.

Referring to FIGS. 8A through 8C, the heating roller 310 includes a multi-layered insulating layer 350', a resistive heating layer 330, a protective layer 361, an elastic layer 363 and a release layer 365 that are sequentially formed on an outer circumference of a supporter 320'. The outer circumference of the supporter 320' includes a stepped portion such that a wiring structure that connects the first electrode terminal 341*a* and the second electrode terminal 342*a* to the first electrode 341 and the second electrode 342 are positioned on the stepped portion of the outer circumference of the supporter 320'. A first layer 351' of the multi-layered insulating layer 350' is formed to cover the entire outer circumference of the supporter 320'. The wiring structure that connects the first electrode terminal 341*a* and the second electrode terminal 342*a* to the first electrode 341 and the second electrode 342 are formed on the first layer 351' of the multi-layered insulating layer 350'. Similar to the above-described exemplary embodiment, second, third and fourth layers 352', 353' and 354' of the multi-layered insulating layer 350', the first electrode 341 and the second electrode 342, the resistive heating layer 330, the protective layer 361, the elastic layer 363, and the release layer 365 are sequentially formed.

In FIGS. 8A through 8C, the portion of the outer circumference of the supporter 320' is stepped to accommodate the wiring structure. Alternatively, grooves may be formed on the outer circumference of the supporter 320' to accommodate the wiring structure connecting the first electrode terminal 341*a* and the second electrode terminal 342*a* to the first electrode 341 and the second electrode 342.

Figure 9A:
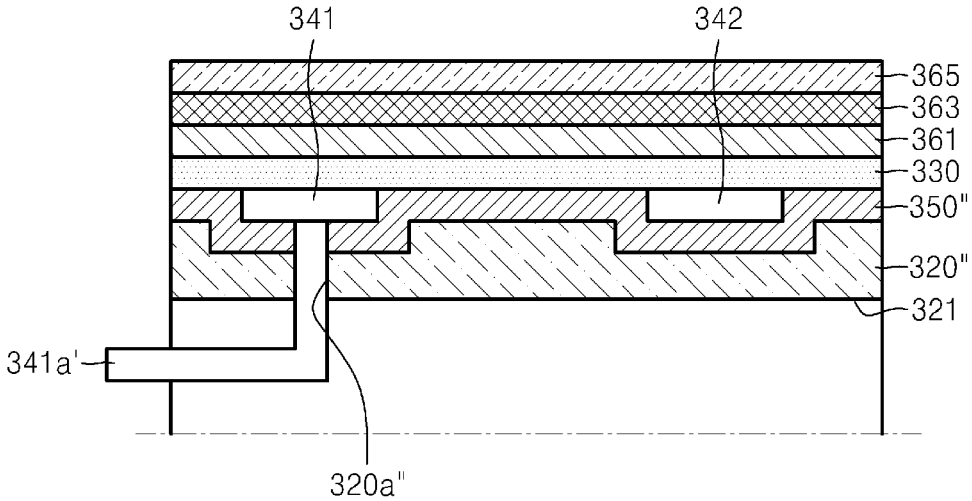
FIGS. 9A through 9C are transverse cross-sectional views of the heating roller of FIG. 6 taken along lines A-A', B-B' and C-C' of FIG. 6, respectively, according to an embodiment of the present general inventive concept.
Figure 9B:
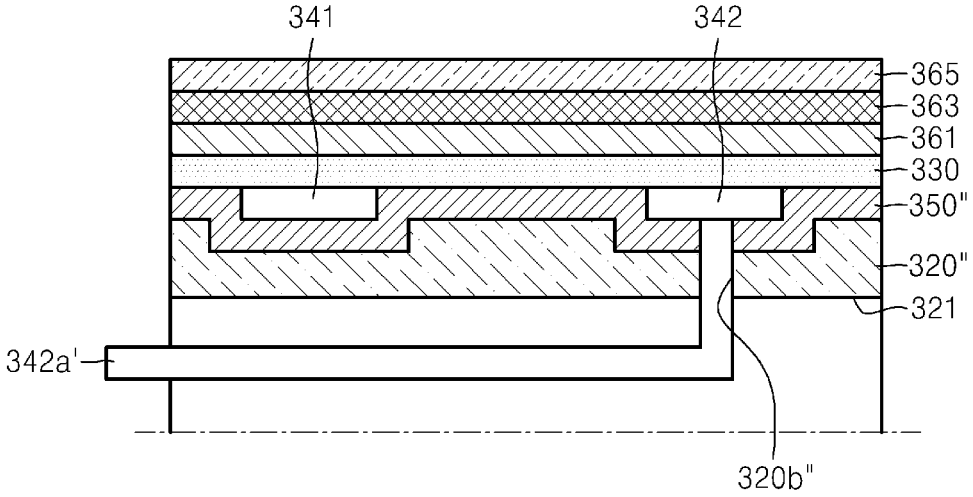
Figure 9C:
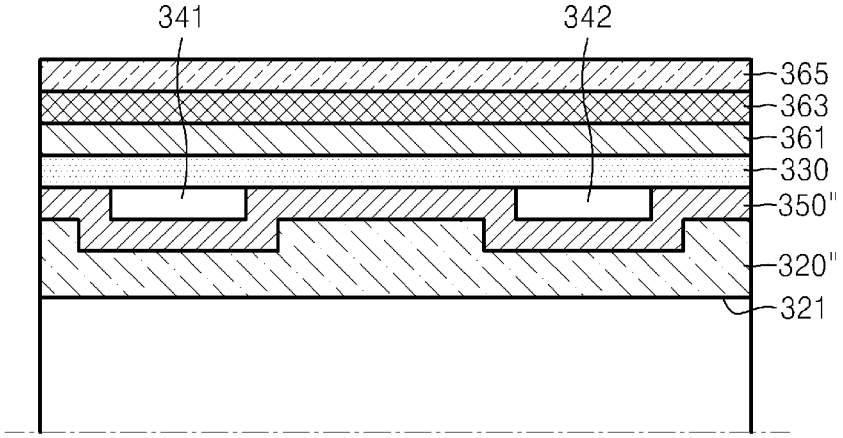

FIGS. 9A through 9C are transverse cross-sectional views of the heating roller 310, taken along lines A-A', B-B' and C-C' of FIG. 6, respectively, according to an exemplary embodiment of the present general concept.

Referring to FIGS. 9A through 9C, a supporter 320" has a cylindrical pipe shape having an internal space defined by an inner circumference 321. A first electrode terminal 341*a'* and a second electrode terminal 342*a'* are connected to the first electrode 341 and the second electrode 342, respectively, through the internal space 321 of the supporter 320", respectively. To achieve this, holes 320*a"* and 320*b"* are provided to wire the first electrode 341 and the second electrode 342 in the supporter 320", prior to forming the first electrode 341 and the second electrode 342. Thus, since a separate wiring structure does not have to be formed on an outer circumference of the supporter 320", an insulating layer 350" may be formed as a single layer between the supporter 320" and the resistive heating layer 330. After forming the insulating layer 350", the first electrode 341 and the second electrode 342 each having a ring shape, the resistive heating layer 330, the protective layer 361, the elastic layer 363, and the release layer 365 are sequentially formed.

Figure 10:
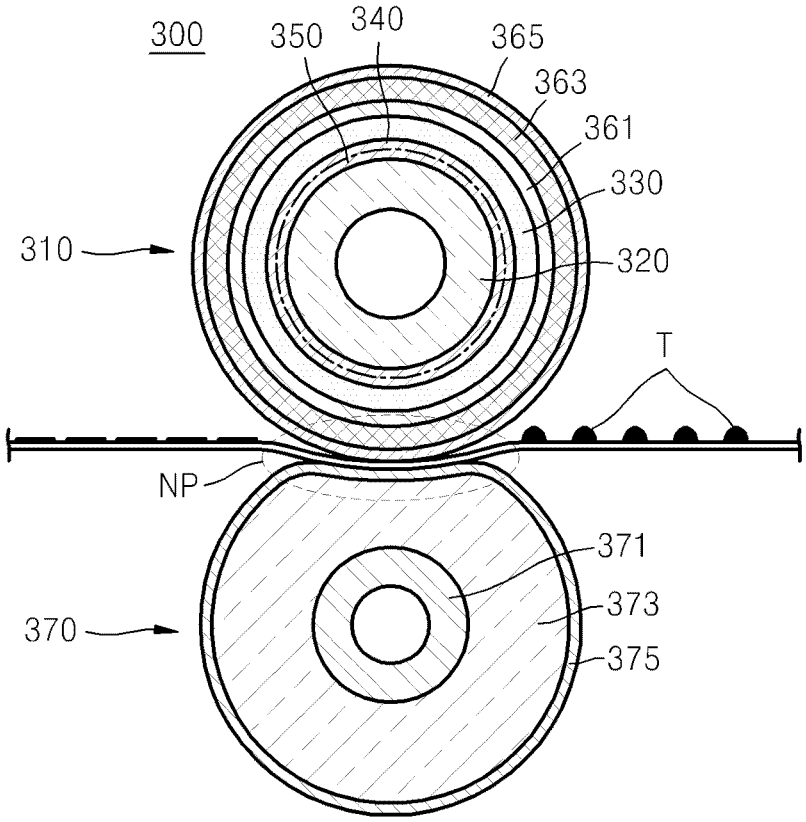
FIG. 10 is a longitudinal cross-sectional view of a fusing device according to an embodiment of the present general inventive concept.

FIG. 10 is a longitudinal cross-sectional view of a fusing device 300 according to an exemplary embodiment of the present general inventive concept.

Referring to FIG. 10, the fusing device 300 includes a heating roller 310 and a compressing roller 370 engaged to each other to form a fixing nip (NP).

The heating roller 310 includes an insulating layer 350 formed on an outer circumference of a supporter 320 having a cylindrical shape, a resistive heating layer 330, a protective layer 361, an elastic layer 363, and a release layer 365. An electrode unit 340 to supply power to the resistive heating layer 330 is disposed between the supporter 320 and the resistive heating layer 330, and electrodes of the electrode unit 340 are insulated by the insulating layer 350.

The supporter 320 may be formed of a material including, but not limited to, metal (e.g., iron and steel, stainless steel, aluminum, and copper), a high heat-resistant plastic that has excellent mechanical properties at high temperatures (e.g., polyphenylene sulfide (PPS), polyamide-imide, polyimide, polyketone, polyphthalamide (PPA), polyether-ether-ketone (PEEK), polythersulfone (PES), or polyetherimide (PEI)), a ceramic, or a glass. Otherwise, the supporter 320 may be formed of any material having mechanical properties that may be maintained at a temperature at which the fusing device 300 may be used. Although the thickness of the supporter 320 may be reduced to increase a warming up time of the resistive heating layer 330, the thickness may be appropriate to form a fixing nip (NP) when pressed against the heating roller 310 and to prevent the heating roller 310 from being damaged due to the pressing. When the supporter 320 is formed of steel, SUS 430, SUS 444, or SUS 303 may be used, and the supporter 320 may be formed so as to have a thickness in the range of about 0.5 to about 2 mm.

The resistive heating layer 330 may be formed as a resistor including, but not limited to, platinum or ruthenium to generate Joule heat at a high power intensity in the range of about 1 $W/cm^2$ to about 60 $W/cm^2$. The resistive heating layer 330 may be formed having a thickness in the range of, for example, about 10 μm to about 100 μm. For example, the resistive heating layer 330 may be formed by dispersing conductive fillers into a base material. In this case, the base material may be a high heat-resistant elastomer, for example, a silicon rubber, and thus the resistive heating layer 330 may function as an elastic layer. The conductive filler may be a metal-based filler including, but not limited to, iron, nickel, aluminum, gold, or silver, and/or a carbon-based filler including, but not limited to, carbon black, chopped carbon-fiber, carbon filament, or carbon coil.

The electrode unit 340 may be formed of a metal material having good electrical conductivity, such as silver or Cu—Sn sinter.

The insulating layer 350 and the protective layer 361 may insulate the supporter 320, may prevent the resistive heating layer 330 from being damaged, and may prevent the resistive heating layer 330 from contacting air so as to prevent oxidation. The insulating layer 350 and the protective layer 361 may be formed by mixing additives in inorganic binders. The insulating layer 350 and the protective layer 361 may be formed of a glass, that is, a kind of inorganic binder, wherein a ratio of glass is in the range of about 30% to about 70%, and the additives include $Al_2O_3$ powders. In order to withstand an internal voltage, the insulating layer 350 may have a thickness in the range of about 50 μm to about 500 μm. The protective layer 361 may be used to protect the resistive heating layer 330, may be used to prevent physical external forces such as external shocks, and may be used to protect a user from current leakage. When the supporter 320 is formed of a conductive material, the insulating layer 350 may prevent a current from flowing into the supporter 320 so as to prevent current leakage.

The elastic layer 363 is used to increase adhesion between the paper P and the heating roller 310 and to ensure a fixing nip (NP). The thickness of a toner T to be accumulated on the paper P may increase during color printing. In this case, the elastic layer 363 may improve the fusing performance of a color toner. When the elastic layer 363 is thin, it is difficult to obtain elasticity of the elastic layer 363. When the elastic layer 363 is thick, thermal efficiency may be degraded. The elastic layer 363 may be a silicon or fluorine rubber having high heat resistance and elasticity, and may be formed having a thickness in the range of about 50 μm to about 800 μm.

The release layer 365 may be the outermost layer of the heating roller 310, and may prevent offsetting of toner, that is, preventing toner on the paper P from being transferred onto a surface of the heating roller 310. The release layer 365 may be formed of a fluoropolymer-based material, including, but not limited to, tetrafluoroethylene/perfluoroalkylvinyl ether copolymer (PFA), polytetrafluorethylene (PTFE) or tetrafluoroethylene/hexafluoropropylene copolymer (FEP). The release layer 365 is not a main element, and thus may be omitted. The release layer 365 may be formed having a thickness in the range of, for example, about 10 μm to about 50 μm.

The compressing roller 370 is an example of a compressing element formed as a roller in which an elastic layer 373 surrounds a metal core 371. A release layer 375 may be formed on an outer circumference of the elastic layer 373.

The elastic layer 373 is used to increase adhesion between the paper P and the heating roller 310 and to ensure a fixing nip (NP), and may be formed of a silicon, solid or fluorine rubber. The elastic layer 373 may be designed according to condition of use, and may be formed having a thickness in the range of about 3 mm to about 11 mm. The elastic layer 373 may use a double structure including a rubber layer and a sponge layer, instead of only a rubber layer, to improve durability.

The release layer 375 may be formed of a fluorine resin, such as a silicon rubber, a fluorine rubber, PFA, PTFE, FEP or PFEP, in order to resist physical wear and to easily release a printing medium. The release layer 375 may be formed having a thickness in the range of about 10 μm to about 100 μm.

The heating roller 310 and the compressing roller 370 are elastically biased to engage each other by an elastic bias element, such as a spring. The elastic layer 373 of the compressing roller 370 may be partially deformed to form a fixing nip (NP) that transfers heat from the heating roller 310 to toner on the paper P.

In a conventional heating roller, since a planar heating element is non-uniformly heated due to a predetermined pattern formed of a nickel alloy film formed by a photography etching technology, a conductive supporter, such as an aluminum pipe, is used to obtain temperature uniformity of a surface of the conventional heating roller. However, the heating roller 310 according to at least one exemplary embodiment of the present general concept includes the electrode unit 340, which may be provided on the inner side of the resistive heating layer 330. Accordingly, a predetermined pattern is not formed on the resistive heating layer 330, and thus non-uniform heat due to a predetermined pattern may be prevented. Thus, unlike in the conventional heating roller, a conductive supporter, such as an aluminum pipe, to obtain temperature uniformity may not be required, a warming-up time is reduced, and a manufacturing process and structure of the heating roller 310 is simplified, thereby reducing manufacturing costs.

If necessary, the compressing roller 370 may have a similar structure as that of the heating roller 310. In this case, a heating region of a resistive heating layer of the compressing roller 370 may not overlap a heating region of the heating roller 310. For example, in cases of a small-sized paper, only the heating roller 310 is heated. In a case of a large-sized paper, both the heating roller 310 and the compressing roller 370 may be heated. In addition, the same voltage may be applied to both the heating roller 310 and the compressing roller 370.

Figure 11:
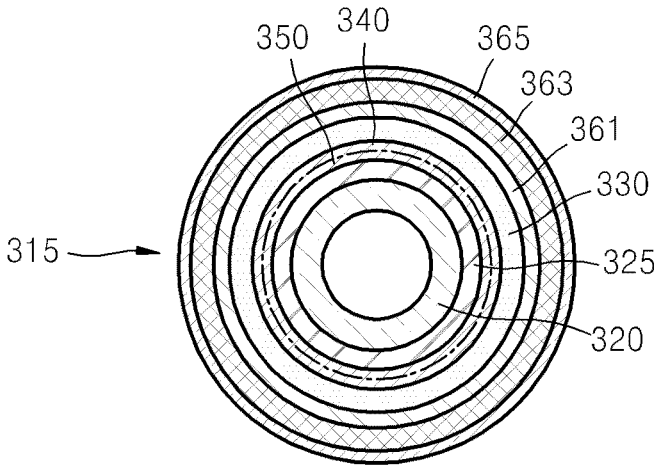
FIG. 11 is a longitudinal cross-sectional view of a heating roller, according to an embodiment of the present general inventive concept.

FIG. 11 is a longitudinal cross-sectional view of a heating roller 315, according to another embodiment of the present general inventive concept.

Referring to FIG. 11, the heating roller 315 includes a heat insulating layer 325, an insulating layer 350, a resistive heating layer 330, a protective layer 361, an elastic layer 363 and a release layer 365 formed on an outer circumference of a supporter 320 having a cylindrical shape. An electrode unit 340 together with the insulating layer 350 is disposed between the supporter 320 and the resistive heating layer 330. The heating roller 315 may be similar to the heating roller 310 according to the above-described embodiments, except that the heat insulating layer 325 is disposed between the supporter 320 and the insulating layer 350.

The heat insulating layer 325 may be formed of foaming silicon rubber, or foaming fluorine rubber. The heating layer 325 may prevent heat generated from the resistive heating layer 330 from diffusing into the supporter 320, and transferring the heat to a surface of the heating roller 315, thereby improving thermal efficiency.

Figure 12:
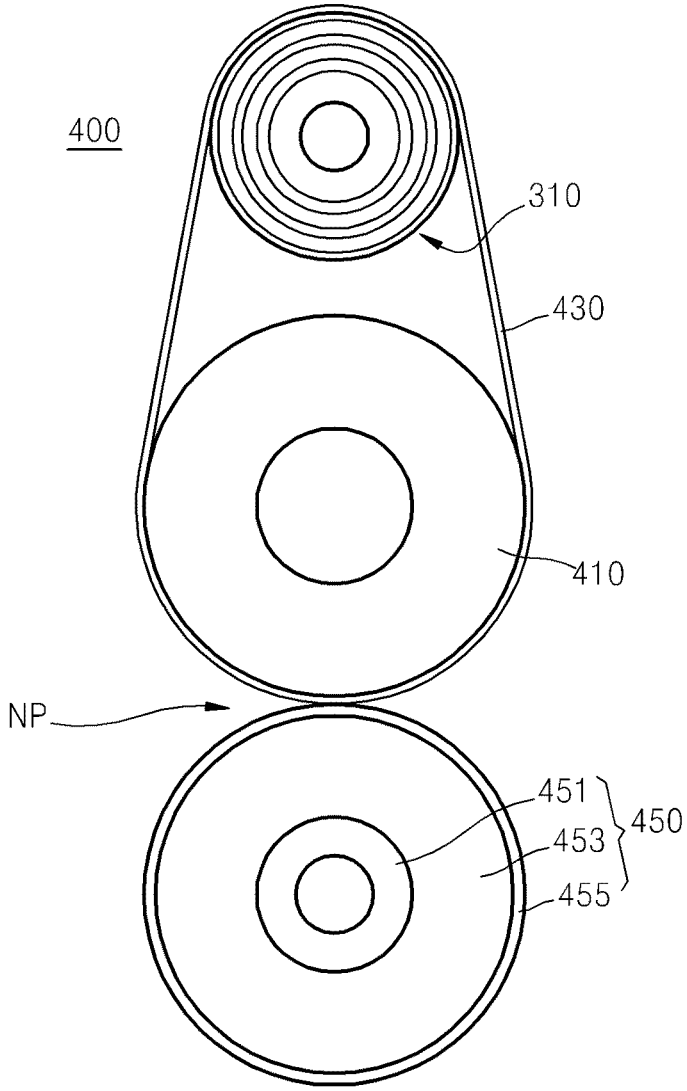
FIG. 12 is a longitudinal cross-sectional view of a fusing device according to an embodiment of the present general inventive concept.

FIG. 12 is a longitudinal cross-sectional view of a fusing device 400 according to an embodiment of the present general inventive concept.

Referring to FIG. 12, the fusing device 400 includes a heating roller 310 that may be similar to any of the heating rollers in the above-embodiments of the present general inventive concept, a fusing roller 410, a belt 430 providing a closed-loop in which the heating roller 310 and the fusing roller 410 are disposed, and a compressing roller 450 engaged to the fusing roller 410 to form a fixing nip (NP). The compressing roller 450 is disposed against the belt 430. In order to form the fixing nip (NP), the fusing roller 410 and the compressing roller 450 are able to rotate while engaged to each other, wherein the belt 430 is disposed between the fusing roller 410 and the compressing roller 450. Although not illustrated, a bias element applies an elastic force to at least one of the fusing roller 410 and the compressing roller 450 so that the fusing roller 410 and the compressing roller 450 are engaged to each other. The compressing roller 450 is an example of a compressing element formed as a roller in which an elastic layer 453 and a release layer 455 are formed on an outer circumference of a metal core 451. The fusing roller 410 is an elastic roller, and may have materially the same structure as that of the compressing roller 450.

Figure 13:
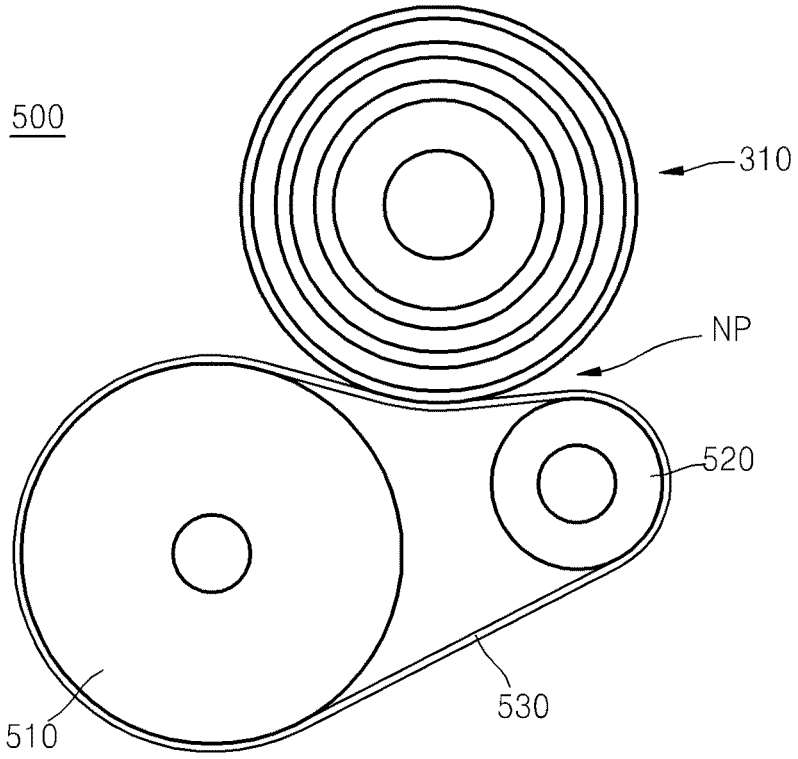
FIG. 13 is a longitudinal cross-sectional view of a fusing device according to an embodiment of the present general inventive concept.

FIG. 13 is a longitudinal cross-sectional view of a fusing device 500 according to another embodiment of the present general inventive concept.

Referring to FIG. 13, the fusing device 500 includes a heating roller 310 that may be similar to any of the heating rollers in the above-embodiments of the present general inventive concept. Additionally, fusing device 500 includes first and second tension rollers 510 and 520, and a belt 530 having a closed-loop shape to engage the first and second tension rollers 510 and 520. The first and second tension rollers 510 and 520 may have materially the same structure as that of the compressing roller 450 of FIG. 12. The first and second tension rollers 510 and 520 apply tension to the belt 530 so as to form a fixing nip (NP) at a region at which the heating roller 310 and the belt 530 contact each other. A compression element according to an exemplary embodiment of the present general inventive concept may be materially the same as that of the above-described embodiments, except that the compression element is formed by the first and second tension rollers 510 and 520, and the belt 530.

So far, an image forming apparatus 100 to form a color image is exemplified as an image forming apparatus including a heating roller 310 and a fusing device (according to embodiments the present general inventive concept. The image forming apparatus further includes a heating roller 310 and a fusing device that may be used in an image forming apparatus to form color images), but the embodiments of the present general inventive concept are not limited thereto. It will be understood by one of ordinary skill in the art that the heating roller 310 and the fusing device according to the embodiments of the present general inventive concept may be used in an image forming apparatus to form a single color image, as well as any of other apparatuses to fuse an image via heating and compressing.

According to the above-described embodiments of the present general inventive concept, a heating area of a resistive heating layer 330 may be adjusted by separately disposing a plurality of elements in an axis direction of a heating roller 310, and by independently controlling each electrode 341, 342, 343 and 344. Thus, the heating roller 310 may correspond to various papers having different sizes, and the temperature of the heating roller 310 may be stably controlled, thereby obtaining good fusing performance. The heating roller 310 may correspond to different sizes of papers by separately disposing electrodes 341, 342, 343 and 344 without heating select portions of a resistive heating layer 330, thereby preventing a problem with non-uniform temperature of the heating roller 310 when the resistive heating layer 330 is selectively heated.

In addition, since a resistive heating layer 330 surrounds an entire heating roller 310, the temperature of a high-speed fusing system may be stabilized (i.e. not decrease). A fusing system having this structure is less likely to succumb to wear caused by friction than in a structure having a planar shape, thereby obtaining a longer lifetime. The resistive heating layer 330 is disposed on a supporter 320, and thus the fusing device is easily manufactured. Additionally, many electrodes 341, 342, 343 and 344 may be formed, and a high warming-up speed may be achieved, compared to a method of forming a heating element and an electrode in a supporter.

While the present general inventive concept has been particularly shown and described with reference to exemplary embodiments thereof, it will be understood by one of ordinary skill in the art that various changes in form and details may be made therein without departing from the spirit and scope of the present general inventive concept as defined by the following claims.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. An electrophotography type image forming apparatus comprising:

an electrophotographic type printing unit configured to transfer a toner image onto a printing medium; and a fusing device to fuse the transferred toner image on the printing medium by heating and compressing the transferred toner image on the printing medium as the printing medium passes through a fixing nip, wherein the fusing device includes:

a heating roller to generate heat; and a compressing element engaged to the heating roller to form the fixing nip, wherein the heating roller comprises:

a supporter extending along a support axis and having a cylindrical outer circumference;

a resistive heating layer being electrically conductive to receive electrical current and that is formed on the outer circumference of the supporter, wherein the resistive heating layer generates heat in response to the electrical current; and a plurality of electrodes, each of the plurality of electrodes being disposed between the supporter and the resistive heating layer, and electrically connected to the resistive heating layer to deliver the electrical current to the resistive heating layer, wherein the plurality of electrodes are spaced apart along a direction of the support axis of the supporter.

2. The image forming apparatus of claim 1, wherein the plurality of electrodes comprises at least three electrodes.

3. The image forming apparatus of claim 1, wherein the plurality of electrodes each have a ring shape to surround portions of the outer circumference of the supporter.

4. The image forming apparatus of claim 1, wherein the plurality of electrodes are arranged in intervals to correspond to papers having different sizes.

5. The image forming apparatus of claim 1, wherein at least one of a stepped portion and a groove to accommodate at least a part of the plurality of electrodes is formed on the outer circumference of the supporter.

6. The image forming apparatus of claim 1, wherein the heating roller further comprises a release layer formed on an outer circumference of the resistive heating layer.

7. The image forming apparatus of claim 6, wherein the heating roller further comprises an elastic layer disposed between the resistive heating layer and the release layer.

8. The image forming apparatus of claim 7, wherein the heating roller further comprises a protective layer for performing an insulating function, disposed between the resistive heating layer and the elastic layer.

9. The image forming apparatus of claim 1, wherein the heating roller further comprises an insulating layer disposed between the plurality of electrodes and the supporter.

10. The image forming apparatus of claim 1, wherein the heating roller further comprises a heat insulating layer disposed between the plurality of electrodes and the supporter.

11. The image forming apparatus of claim 1, wherein the heating roller further comprises a plurality of electrode terminals disposed at ends of the supporter, and wherein the plurality of electrode terminals are connected to the plurality of electrodes, respectively.

12. The image forming apparatus of claim 1, wherein the compressing element has at least one of a roller shape and a belt shape.

13. The image forming apparatus of claim 1, wherein the compressing element comprises a resistive heating layer disposed on regions of the heating roller not covered by the resistive heating layer.

14. An electrophotography type image forming apparatus comprising:

an electrophotographic type printing unit configured to transfer a toner image onto a printing medium; and a fusing device to fuse the transferred toner image on the printing medium by heating and compressing the transferred toner image on the printing medium as the printing medium passes through a fixing nip, wherein the fusing device includes:

a heating roller to generate heat; and a belt engaging an outer circumference of the heating roller and circulating around the outer circumference;

a tension roller to apply tension to the belt; and a compressing element engaged with the tension roller to form the fixing nip, wherein the belt is disposed between the tension roller and the compressing element, wherein the heating roller comprises:

a supporter extending along a supporter support axis and having a cylindrical outer circumference;

a resistive heating layer being electrically conductive to receive electrical current and that is formed on the outer circumference of the supporter, wherein the resistive heating layer generates heat in response to receiving the electrical current; and a plurality of electrodes disposed between the supporter and the resistive heating layer, and electrically connected to the resistive heating layer to supply power to the resistive heating layer, wherein the plurality of electrodes are spaced apart along a direction of the support axis of the supporter.

15. The image forming apparatus of claim 14, wherein the plurality of electrodes comprises at least three electrodes.

16. The image forming apparatus of claim 14, wherein the plurality of electrodes each have a ring shape to surround portions of the outer circumference of the supporter.

17. The image forming apparatus of claim 14, wherein the plurality of electrodes is arranged in intervals to correspond to papers having different sizes.

18. The image forming apparatus of claim 14, wherein at least one of a stepped portion and a groove to accommodate at least a part of the plurality of electrodes is formed on the outer circumference of the supporter.

19. The image forming apparatus of claim 14, wherein the heating roller further comprises a heat insulating layer disposed between the plurality of electrodes and the supporter.

20. The image forming apparatus of claim 14, wherein the heating roller further comprises a plurality of electrode terminals disposed at ends of the supporter, and wherein the plurality of electrode terminals are connected to the plurality of electrodes, respectively.

* * * * *